US009690237B2

(12) United States Patent
Miyakoshi

(10) Patent No.: US 9,690,237 B2
(45) Date of Patent: Jun. 27, 2017

(54) IMAGE FORMING APPARATUS CAPABLE OF PREVENTING DISPLACEMENT OF TRANSFER UNIT

(71) Applicant: KYOCERA Document Solutions Inc., Osaka-shi, Osaka (JP)

(72) Inventor: Naoto Miyakoshi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/065,661

(22) Filed: Mar. 9, 2016

(65) Prior Publication Data

US 2016/0266522 A1 Sep. 15, 2016

(30) Foreign Application Priority Data

Mar. 9, 2015 (JP) ..... 2015-046421

(51) Int. Cl.
*G03G 15/16* (2006.01)
*G03G 21/16* (2006.01)

(52) U.S. Cl.
CPC ..... *G03G 15/162* (2013.01); *G03G 21/168* (2013.01); *G03G 21/1623* (2013.01); *G03G 2221/1642* (2013.01); *G03G 2221/1684* (2013.01)

(58) Field of Classification Search
CPC . G03G 15/162; G03G 21/1623; G03G 21/168
USPC ..... 399/121
See application file for complete search history.

(56) References Cited

U.S. PATENT DOCUMENTS

2007/0048010 A1* 3/2007 Nakano ..... B65H 5/021 399/121
2014/0186073 A1 7/2014 Ju et al.

FOREIGN PATENT DOCUMENTS

EP 2725430 A2 4/2014
JP 2004163795 A 6/2004

OTHER PUBLICATIONS

European Patent Office, Extended European Search Report Issued in Application No. 16159336.3, Aug. 16, 2016, Germany, 8 pages.

* cited by examiner

*Primary Examiner* — Quana M Grainger
(74) *Attorney, Agent, or Firm* — Alleman Hall Creasman & Tuttle LLP

(57) ABSTRACT

An image forming apparatus includes: a guide groove for a rotation shaft; a positioning groove provided on a guide surface, for the rotation shaft, in the guide groove; a pressing member provided so as to be rotatable about a support shaft provided at the opening side with respect to the positioning groove, and configured to press the rotation shaft in a groove depth direction of the positioning groove; and a lower surface portion configured to apply a first pressing force in the groove depth direction to the rotation shaft in a fit-in state where the rotation shaft is located at a fit-in position, and apply a second pressing force in the inserting direction to the rotation shaft against the first pressing force in an escape state where the rotation shaft is located at an escape position.

6 Claims, 11 Drawing Sheets

IMAGE FORMING APPARATUS CAPABLE OF PREVENTING DISPLACEMENT OF TRANSFER UNIT

INCORPORATION BY REFERENCE

This application is based upon and claims the benefit of priority from the corresponding Japanese Patent Application No. 2015-046421 filed on Mar. 9, 2015, the entire contents of which are incorporated herein by reference.

BACKGROUND

The present disclosure relates to an image forming apparatus that allows an intermediate transfer unit to be inserted into and pulled from an apparatus main body.

An image forming apparatus including an intermediate transfer unit having an endless transfer belt extended on and between a plurality of rollers is widely known. In the image forming apparatus, the intermediate transfer unit can be inserted into and pulled from an apparatus main body in a horizontal direction. In addition, rail members for guiding horizontal movement of the intermediate transfer unit when the intermediate transfer unit is inserted or pulled are provided in the apparatus main body. That is, each rail member is provided with a guide groove extending from an end portion thereof at the upstream side in an inserting direction toward the downstream side in the inserting direction, and the guide groove guides the intermediate transfer unit while supporting a rotation shaft of the roller, when the intermediate transfer unit is inserted or pulled. Moreover, a positioning groove is provided at a deep portion of the guide groove at the downstream side in the inserting direction so as to be engageable with the rotation shaft, and the rotation shaft is brought into engagement with the positioning groove, thereby restricting movement of the intermediate transfer unit in the inserting/pulling direction. Furthermore, an arm member is provided which presses the rotation shaft engaged with the positioning groove, in a direction in which the rotation shaft is caused to fit into the positioning groove. The arm member restricts displacement of the roller and further displacement of the intermediate transfer unit.

Meanwhile, in such a type of an image forming apparatus, in an image non-forming period when an image forming operation is not performed, the intermediate transfer unit is driven by a predetermined drive mechanism such that all photosensitive drums and primary transfer rollers do not nip the transfer belt therebetween. At this time, the rotation shaft is displaced against a biasing force of the arm member in a direction in which the rotation shaft escapes from the positioning groove.

SUMMARY

An image forming apparatus according to one aspect of the present disclosure includes an apparatus main body, a transfer unit, a pair of support members, a guide groove, a positioning groove, a pressing member, and a pressing force application portion. The apparatus main body has a housing space formed therein and an opening communicating with the housing space. The transfer unit includes an extending roller including a rotation shaft and a transfer belt supported on the extending roller, and is able to be inserted into the housing space through the opening along a first direction that crosses an axial direction of the rotation shaft and is a direction from the opening toward the housing space. The pair of support members are provided in the apparatus main body, are spaced apart from each other in the axial direction across the housing space, and are configured to support the transfer unit inserted in the housing space and support the rotation shaft such that the rotation shaft is movable in the first direction. The guide groove extends from an end portion, at the opening side, of each of the pair of support members toward the first direction and is configured to guide the rotation shaft in the first direction in a process of inserting the transfer unit. The positioning groove is provided on a guide surface, for the rotation shaft, in the guide groove and is configured to position the transfer unit at a predetermined mounting position in a state where the rotation shaft has fitted in the positioning groove. The pressing member is provided so as to be rotatable about a support shaft provided at the opening side with respect to the positioning groove and extending in the axial direction, and is configured to come into contact with the rotation shaft and press the rotation shaft in a groove depth direction of the positioning groove when the rotation shaft is present in a range from a fit-in position at which the rotation shaft has fitted in the positioning groove to an escape position at which the rotation shaft has escaped from the positioning groove. The pressing force application portion includes a contact portion of the pressing member, and the contact portion is configured to come into contact with the rotation shaft. The pressing force application portion is configured to apply a first pressing force in the groove depth direction to the rotation shaft in a fit-in state where the rotation shaft is located at the fit-in position, and apply a second pressing force in the first direction to the rotation shaft against the first pressing force in an escape state where the rotation shaft is located at the escape position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the drawings. It should be noted that the embodiments described below are merely examples embodying the present disclosure, and do not limit the technical scope of the present disclosure.

Figure 1:
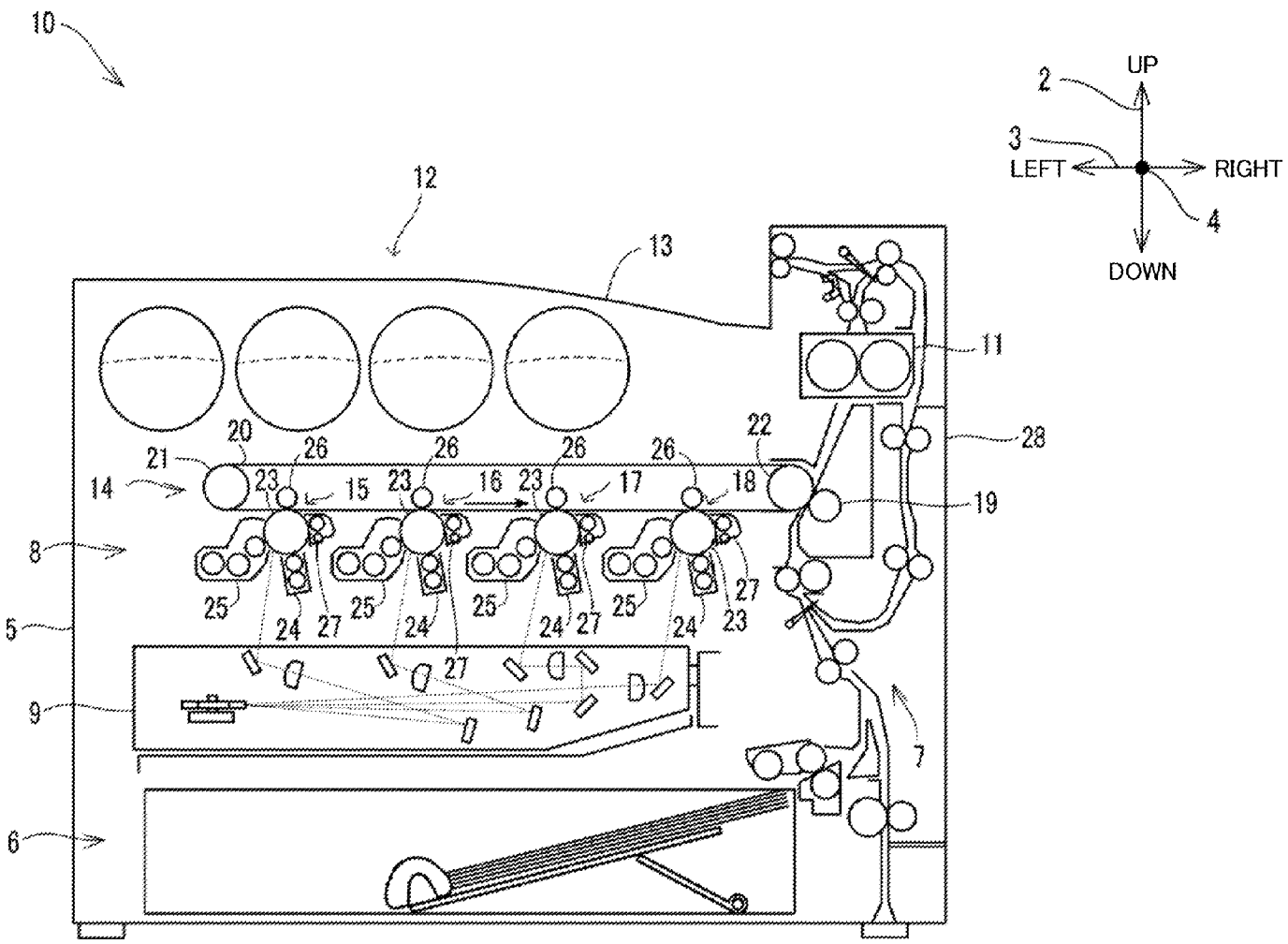
FIG. 1 is a diagram showing the configuration of an image forming apparatus according to a first embodiment of the present disclosure.

FIG. 1 is a diagram showing the configuration of an image forming apparatus 10 according to a first embodiment of the present disclosure. In the following description, an up-down direction 2, a right-left direction 3, and a front-rear direction 4 shown in FIG. 1 are sometimes used.

The image forming apparatus 10 shown in FIG. 1 is an electrophotographic type image forming apparatus. The image forming apparatus 10 is a color printer, and is able to perform an image forming process (printing process) of forming a color or monochrome image by electrophotography on the basis of image data inputted from an information processing apparatus such as a personal computer.

Specifically, the image forming apparatus 10 includes a sheet feed portion 6, a sheet conveying portion 7, an image forming portion 8, an optical scanning portion 9, a fixing portion 11, a container mounting portion 12, and a sheet discharge portion 13, etc. within an apparatus main body 5. In the present embodiment, the image forming portion 8 is located substantially at the center, in the up-down direction 2, of the apparatus main body 5, and the optical scanning portion 9 is disposed below the image forming portion 8. The sheet feed portion 6 is disposed below the optical scanning portion 9. The sheet conveying portion 7 in which a conveyance path for conveying a sheet member in the up-down direction 2 is formed is provided at the right side of the sheet feed portion 6, the optical scanning portion 9, and the image forming portion 8. The container mounting portion 12 is provided above the image forming portion 8. The sheet discharge portion 13 is provided at the upper surface of the apparatus main body 5.

The sheet feed portion 6 sends out the sheet member to the sheet conveying portion 7, and the sheet conveying portion 7 conveys the sheet member from the lower side to the sheet discharge portion 13 at the upper side. The image forming portion 8 forms a monochrome or color toner image, and transfers the toner image at a predetermined secondary transfer position onto the sheet member being conveyed by the sheet conveying portion 7. The fixing portion 11 fixes the toner image transferred onto the sheet member, to the sheet member by heating and pressurization at a predetermined fixing position at the downstream side of the secondary transfer position. Accordingly, an image is formed on the sheet member. Thereafter, the sheet conveying portion 7 discharges the sheet member having the image formed thereon, to the sheet discharge portion 13.

The image forming apparatus 10 is a tandem-type image forming apparatus, and the image forming portion 8 includes an intermediate transfer portion 14, a plurality of single-color image forming portions 15 to 18, and a secondary transfer roller 19.

The intermediate transfer portion 14 includes a transfer belt 20 and a plurality of extending rollers 21. Rotation shafts 49 of the plurality of extending rollers 21 extend in the front-rear direction 4, and the plurality of extending rollers 21 are disposed so as to be spaced apart from each other in the right-left direction 3 and opposed to each other at a predetermined interval.

The transfer belt 20 is an endless band-like member formed in a loop shape, and is extended on and between the plurality of extending rollers 21 and supported thereon. The transfer belt 20 is an example of a transfer belt of the present disclosure.

Among the plurality of extending rollers 21, the extending roller 21 located at the right side is a roller that rotates by a driving force supplied from a power source, which is not shown, to cause the transfer belt 20 to run. Hereinafter, the extending roller 21 is referred to as driving roller 22, and thus is distinguished from the other extending roller 21. The driving roller 22 is an example of an extending roller of the present disclosure. When the driving roller 22 is rotationally driven, the transfer belt 20 runs around in the right-left direction 3 of the image forming apparatus 10. The number of the extending rollers 21 including the driving roller 22 is two in the present embodiment, but may be three or more.

The single-color image forming portions 15 to 18 form toner images having colors different from each other. The single-color image forming portion 15 is an image forming portion corresponding to Y (yellow), the single-color image forming portion 16 is an image forming portion corresponding to C (cyan), the single-color image forming portion 17 is an image forming portion corresponding to M (magenta), and the single-color image forming portion 18 is an image forming portion corresponding to K (black).

The single-color image forming portions 15 to 18 are arranged in the direction in which the transfer belt 20 runs, that is, in the right-left direction 3 of the image forming apparatus 10. Specifically, the single-color image forming portion 15, the single-color image forming portion 16, the single-color image forming portion 17, and the single-color image forming portion 18 are arranged along the right-left direction 3 of the image forming apparatus 10 in order from the left side.

The single-color image forming portions 15 to 18 have the same configuration, and each includes a photosensitive drum 23, a charging device 24, a developing device 25, a primary transfer roller 26, and a cleaning device 27, etc.

In each of the single-color image forming portions 15 to 18, the photosensitive drum 23 receives a driving force supplied from the power source, which is not shown, to rotate at a peripheral speed corresponding to the peripheral speed (moving speed) of the transfer belt 20, and the charging device 24 uniformly charges the surface of the photosensitive drum 23. Furthermore, the optical scanning portion 9 performs scanning with laser light, thereby forming an electrostatic latent image on the charged surface of the photosensitive drum 23. The developing device 25 supplies toner to the photosensitive drum 23 to develop the electrostatic latent image, thereby forming a toner image on the surface of the photosensitive drum 23.

The primary transfer roller 26 transfers the toner image formed on the surface of the photosensitive drum 23, onto the transfer belt 20. Specifically, in a state where the corresponding primary transfer roller 26 and photosensitive drum 23 nip the transfer belt 20 therebetween, a predetermined potential difference is applied between the primary transfer roller 26 and the transfer belt 20 by a power supply device that is not shown. Accordingly, an electric field is formed between the primary transfer roller 26 and the surface of the photosensitive drum 23, so that the toner image formed on the surface of the photosensitive drum 23 is transferred onto the surface of the transfer belt 20.

Onto the surface of the transfer belt 20, the toner images formed in the respective single-color image forming portions 15 to 18 are transferred in an overlaid manner. Accordingly, a color toner image is formed on the transfer belt 20. The transfer belt 20 conveys the color toner image to the transfer position.

The secondary transfer roller 19 transfers a monochrome or color toner image formed on the transfer belt 20, onto the sheet member at the secondary transfer position. Specifically, the secondary transfer roller 19 is disposed, for example, obliquely rightward and downward of the driving roller 22, so as to be opposed to the driving roller 22, and the secondary transfer roller 19 and the driving roller 22 nip the transfer belt 20 therebetween. That is, the secondary transfer roller 19 is disposed so as to be able to come into pressure contact with the surface of the driving roller 22 with a predetermined pressure contact force F4 (see FIG. 9) in a state where (a bearing member 40 for) the rotation shaft 49 has fitted in a later-described positioning groove 101.

In this state, a predetermined potential difference is applied between the secondary transfer roller 19 and the transfer belt 20 by the power supply device that is not shown. Accordingly, an electric field is formed between the secondary transfer roller 19 and the transfer belt 20, so that the toner image attached on the surface of the transfer belt 20 is transferred onto the sheet member.

Figure 2:
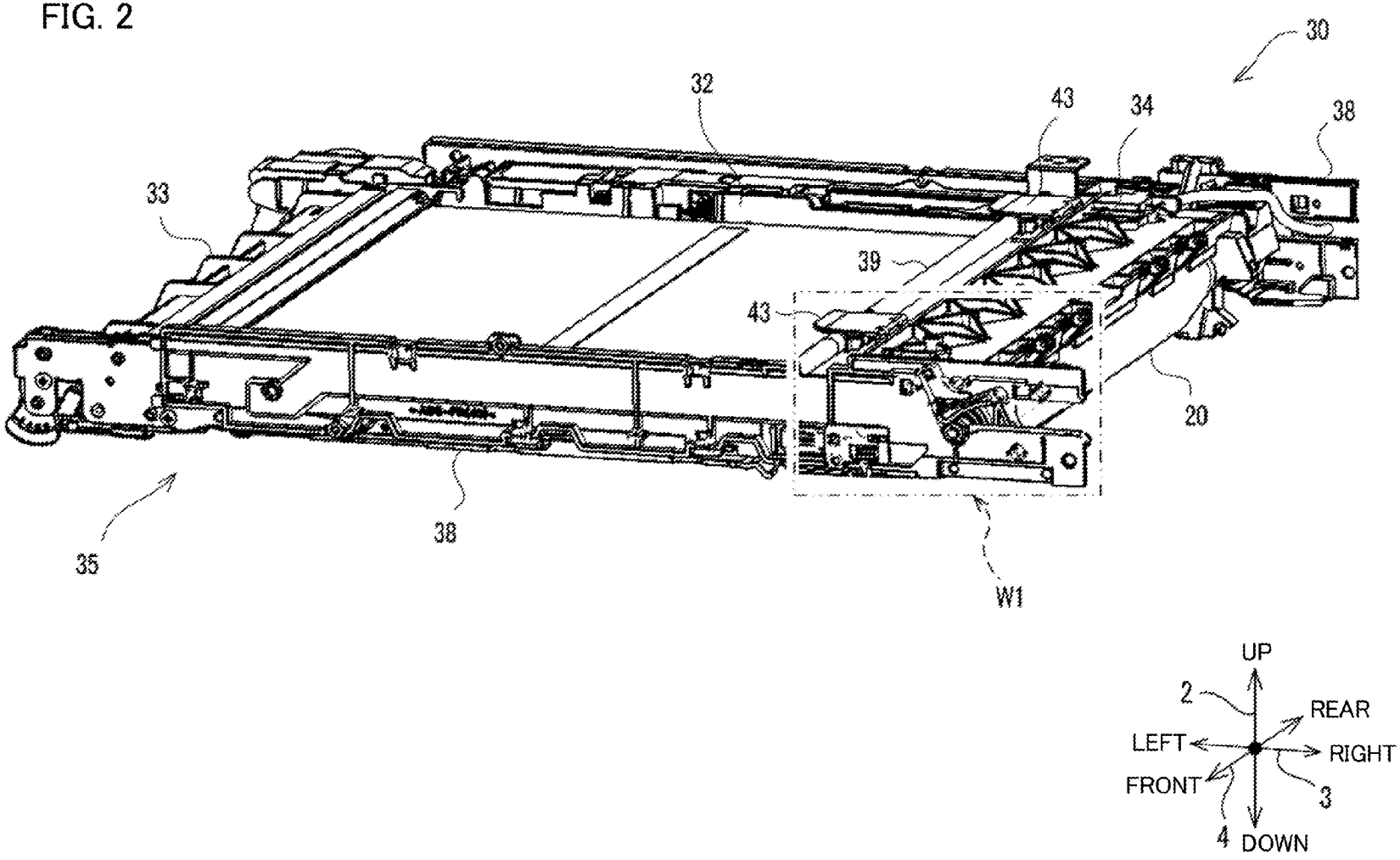
FIG. 2 is an external perspective view of an intermediate transfer unit.

The extending roller 21, the driving roller 22, the transfer belt 20, and the primary transfer roller 26 are integrated as an intermediate transfer unit 30. That is, the intermediate transfer unit 30 includes: the transfer belt 20 supported on the driving roller 22; and the driving roller 22 including the rotation shaft 49. FIG. 2 shows the external appearance of the intermediate transfer unit 30. In FIG. 2, the extending roller 21 and the primary transfer roller 26 are not shown. The intermediate transfer unit 30 is an example of a transfer unit of the present disclosure.

As shown in FIG. 2, the intermediate transfer unit 30 includes a unit main body 35. The unit main body 35 is formed in a rectangular shape by a front frame (not shown) and a rear frame 32 that extend in the right-left direction 3 and a left frame 33 and a right frame 34 that extend in the front-rear direction 4. The extending roller 21 is covered by the left frame 33, and the driving roller 22 is covered by the right frame 34. In addition, the extending roller 21 and the driving roller 22 are rotatably supported at both ends by the front frame and the rear frame 32. Moreover, the primary transfer rollers 26 are arranged in the right-left direction 3 within the unit main body 35.

A joint gear (not shown) is provided on one end of the rotation shaft 49 (see FIG. 11) of the driving roller 22. Meanwhile, a joint gear (not shown) is also provided on the apparatus main body 5. These joint gears mesh with each other when the intermediate transfer unit 30 is in a horizontal attitude. A drive motor that is not shown is connected to the joint gear on the apparatus main body 5, and a driving force generated by the drive motor is transmitted to the driving roller 22 via these joint gears. Accordingly, the driving roller 22 rotates. The drive motor generates the driving force that rotates the rotation shaft 49 in a circumferential direction thereof. As the drive motor, for example, a stepping motor or a DC motor may be used.

The apparatus main body 5 includes a cover member 28, an opening 41, a front plate 36, a rear plate 37, and a housing space S1.

Figure 3A:
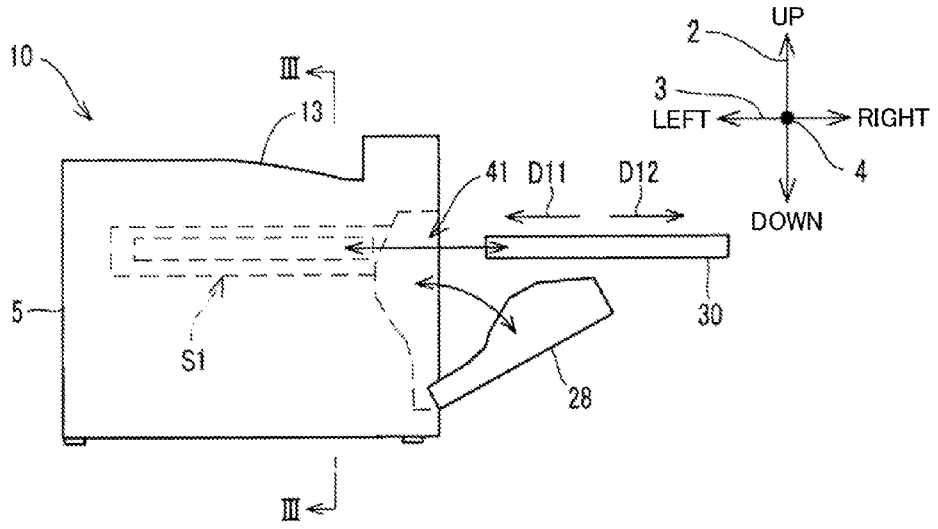
FIG. 3A is a schematic diagram showing insertion and pulling of the intermediate transfer unit into and from the apparatus main body.

An opening/closing operation required for attaching or detaching the intermediate transfer unit 30 to or from the apparatus main body 5 is performed on the cover member 28. The cover member 28 includes a rotation shaft that is rotatably supported on the apparatus main body 5 and is not shown, and is provided in the apparatus main body 5 so as to be rotatable between an open attitude (see a solid line in FIG. 3A) and a closed attitude (see a virtual line in FIG. 3A) in a state where the rotation shaft is rotatably supported on the apparatus main body 5. When the cover member 28 is made into the open attitude, the opening 41 for inserting or pulling the intermediate transfer unit 30 into or from the apparatus main body 5 is exposed. When the cover member 28 is made into the closed attitude, the opening 41 is closed.

Figure 3B:
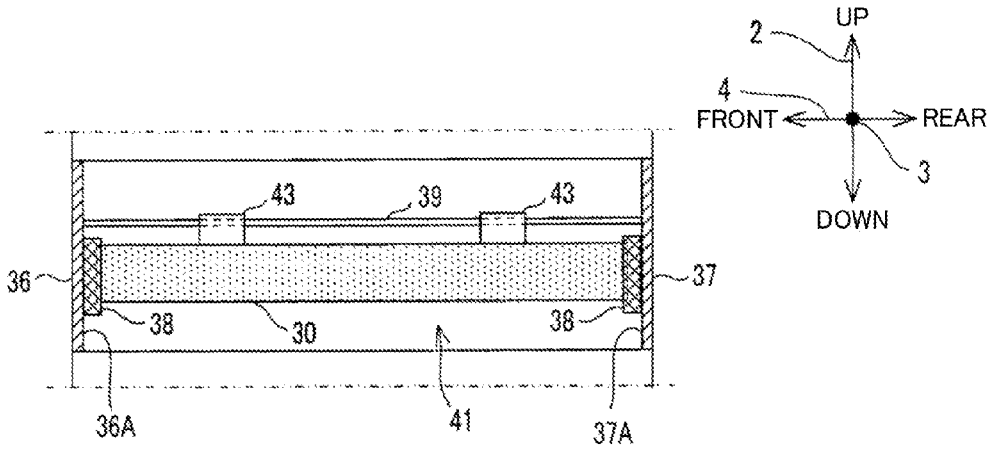
FIG. 3B is a cross-sectional view as seen from the direction of arrows in FIG. 3A.

As shown in FIG. 3B, the housing space S1 is a space for housing the intermediate transfer unit 30, and is formed between the front plate 36 and the rear plate 37. The housing space S1 communicates with the opening 41. Therefore, when the cover member 28 is in the open attitude, it is possible to insert the intermediate transfer unit 30 into the housing space S1 form the outside of the apparatus main body 5, or pull out the intermediate transfer unit 30 from the housing space S1 to the outside of the apparatus main body 5. Hereinafter, the right-left direction 3 is sometimes referred to as inserting/pulling direction 3. As described above, the apparatus main body 5 has the housing space S1 formed therein and has the opening 41 that communicates with the housing space S1. In addition, the intermediate transfer unit 30 can be inserted into the housing space S1 through the opening 41 along a leftward direction that crosses the axial direction of the rotation shaft 49 and is a direction from the opening 41 toward the housing space S1. Hereinafter, the direction in which the intermediate transfer unit 30 is inserted is referred to as inserting direction D11. The inserting direction D11 coincides with the leftward direction in the right-left direction 3, and is an example of a first direction of the present disclosure.

In the present embodiment, the cover member 28 is provided at the right side surface of the apparatus main body 5, and the intermediate transfer unit 30 is inserted or pulled at a right side portion of the apparatus main body 5. However, the inserting/pulling direction 3 of the intermediate transfer unit 30 and the position on the apparatus main body 5 at which the intermediate transfer unit 30 is inserted or pulled are not limited to the above.

The image forming apparatus 10 includes a unit tilt mechanism 70. The unit tilt mechanism 70 includes a drive mechanism 71 and hook members 43. The drive mechanism 71 includes a unit tilt shaft 39, eccentric cams 44, a power transmission mechanism (not shown), and a drive motor (not shown).

As shown in FIG. 3B, the unit tilt shaft 39 extends between the front plate 36 and the rear plate 37 of the apparatus main body 5 along the front-rear direction 4, and is rotatably supported on the front plate 36 and the rear plate 37. A power transmission path is formed between the unit tilt shaft 39 and a motor shaft (not shown) of the drive motor via the power transmission mechanism. The drive motor generates a driving force that rotates the unit tilt shaft 39 in a circumferential direction thereof. As the drive motor, for example, a stepping motor or a DC motor may be used.

Figure 4A:
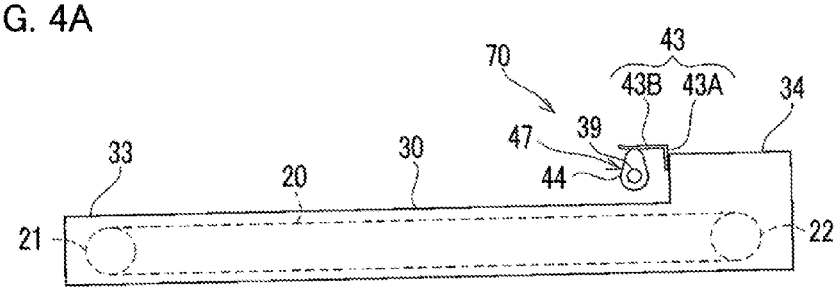
FIG. 4A is a diagram showing a state where a long diameter portion of an eccentric cam is brought into engagement with a hook member and an intermediate transfer belt is made into a tilted attitude.
Figure 4B:
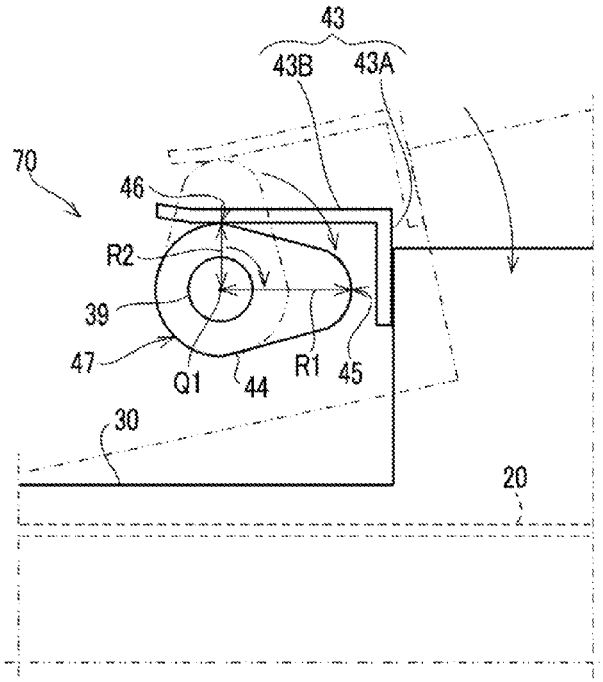
FIG. 4B is a diagram for explaining a change in the attitude of the intermediate transfer unit due to a change in the attitude of the eccentric cam.

As shown in FIGS. 4A and 4B, each eccentric cam 44 is provided at a later-described position on the unit tilt shaft 39. Each eccentric cam 44 has a circumferential surface 47 to which a distance (diameter) R from an axial position Q1 (see FIG. 4B) of the unit tilt shaft 39 is different. The circumferential surface 47 generally includes: a long diameter portion 45 having a distance R1 as the distance R from the axial position Q1; and a short diameter portion 46 having, as the distance R from the axial position Q1, a distance R2 shorter than the distance R1.

When the unit tilt shaft 39 is rotationally driven by the drive motor, each eccentric cam 44 can take a lateral attitude (see a solid line in FIG. 4B) or a vertical attitude (see a virtual line in FIG. 4B). The lateral attitude is an attitude in which the long diameter portion 45 is located laterally to the unit tilt shaft 39, and the vertical attitude is an attitude in which the long diameter portion 45 is located vertically to the unit tilt shaft 39.

As shown in FIGS. 4A and 4B, the hook members 43 are provided on the right frame 34 of the intermediate transfer unit 30. Specifically, each hook member 43 is a member that has an L cross-sectional shape and includes a first flat plate portion 43A and a second flat plate portion 43B that are orthogonal to each other. Each hook member 43 is attached at the first flat plate portion 43A to the right frame 34 in an attitude in which the second flat plate portion 43B extends above the unit tilt shaft 39 and toward the left frame 33 side.

The hook members 43 are provided at positions corresponding to the positions of the eccentric cams 44. When the intermediate transfer unit 30 is inserted into the apparatus main body 5, the second flat plate portion 43B of each hook member 43 and the circumferential surface 47 of each eccentric cam 44 are brought into engagement with each other.

Figure 4C:
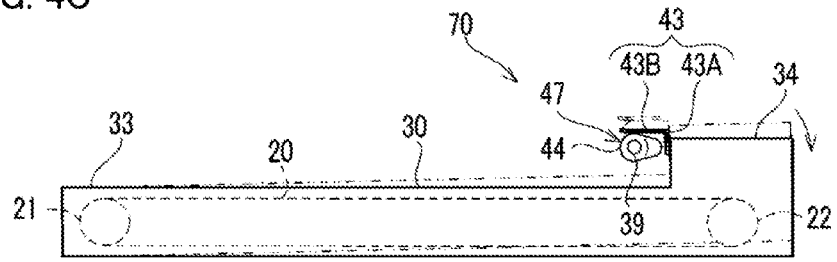
FIG. 4C is a diagram showing a state where a short diameter portion of the eccentric cam is brought into engagement with the hook member and the intermediate transfer belt is made into a horizontal attitude.

Because of such a configuration, the attitude of the intermediate transfer unit 30 changes in accordance with the attitudes of the eccentric cams 44. That is, when each eccentric cam 44 is in the vertical attitude, the long diameter portion 45 is brought into contact with the second flat plate portion 43B, whereby the intermediate transfer unit 30 is made into a tilted attitude in which the right frame 34 side thereof is located above the left frame 33 side thereof (see virtual lines in FIGS. 4A and 4B). Meanwhile, when each eccentric cam 44 is in the lateral attitude, the short diameter portion 46 is brought into contact with the second flat plate portion 43B, whereby the intermediate transfer unit 30 is made into a horizontal attitude (see solid lines in FIGS. 4C and 4B). In FIG. 4B, the tilted attitude is illustrated in a slightly exaggerated manner regarding a tilt angle such that an attitude change between the tilted attitude of the intermediate transfer unit 30 shown in FIG. 4A and the horizontal attitude of the intermediate transfer unit 30 shown in FIG. 4C can be easily visually recognized.

Figure 5A:
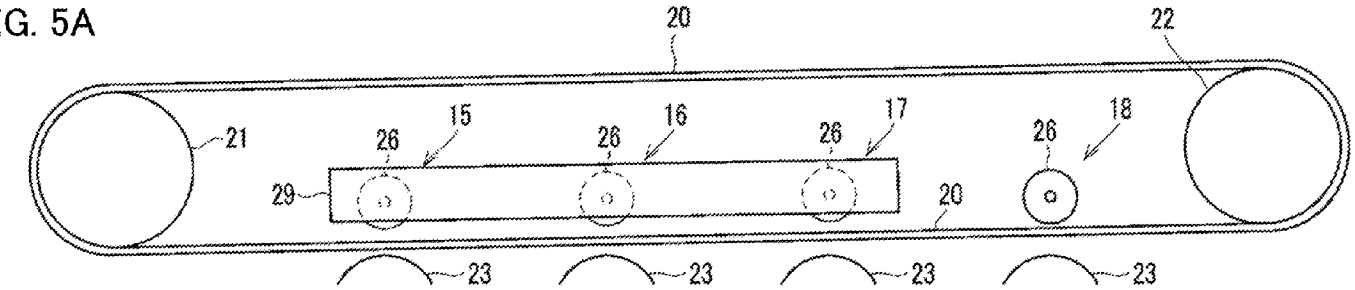
FIG. 5A is a diagram showing a positional relationship between each primary transfer roller and each photosensitive drum in an image non-forming period.

The image forming apparatus 10 sets the attitude of each eccentric cam 44 in accordance with whether the present time is an image forming period. That is, in an image non-forming period including a period when the intermediate transfer unit 30 is not inserted in the apparatus main body 5, the image forming apparatus 10 sets each eccentric cam 44 in the vertical attitude, thereby making the intermediate transfer unit 30 into the tilted attitude. At this time, as shown in FIG. 5A, all the primary transfer rollers 26 provided in the intermediate transfer unit 30 are separated from the transfer belt 20. That is, a state is obtained in which nipping the transfer belt 20 by the primary transfer roller 26 and the photosensitive drum 23 in each of the single-color image forming portions 15 to 18 is all cancelled.

As described above, in the present embodiment, by the intermediate transfer unit 30 being set in the tilted attitude in the image non-forming period, it is made possible to detach the intermediate transfer unit 30 from the apparatus main body 5 in the image non-forming period. In addition, a trace can be prevented from being formed on the transfer belt 20 due to nipping the transfer belt 20 by the primary transfer roller 26 and the photosensitive drum 23.

Meanwhile, in an image forming period, the image forming apparatus 10 sets each eccentric cam 44 in the lateral attitude, thereby making the intermediate transfer unit 30 into the horizontal attitude. At this time, a state is obtained in which at least the primary transfer roller 26 and the photosensitive drum 23 in the single-color image forming portion 18 corresponding to K (black) nip the transfer belt 20 therebetween.

Figure 5B:
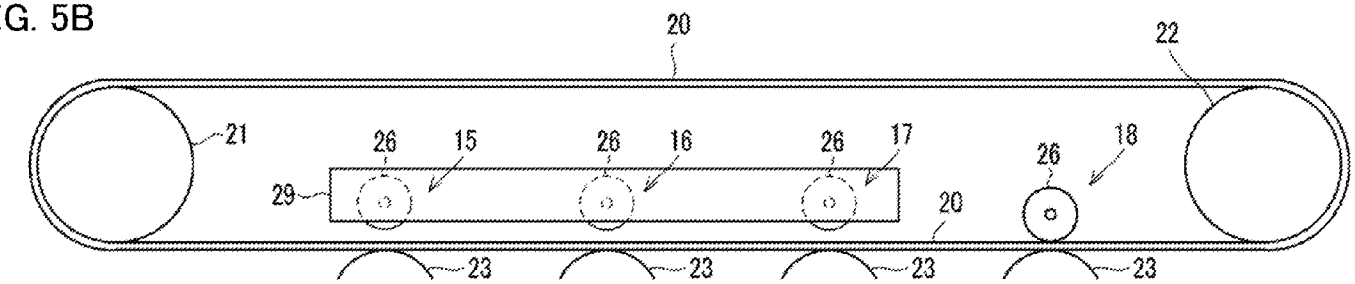
FIG. 5B is a diagram showing a positional relationship between each primary transfer roller and each photosensitive drum in a monochrome image forming period.
Figure 5C:
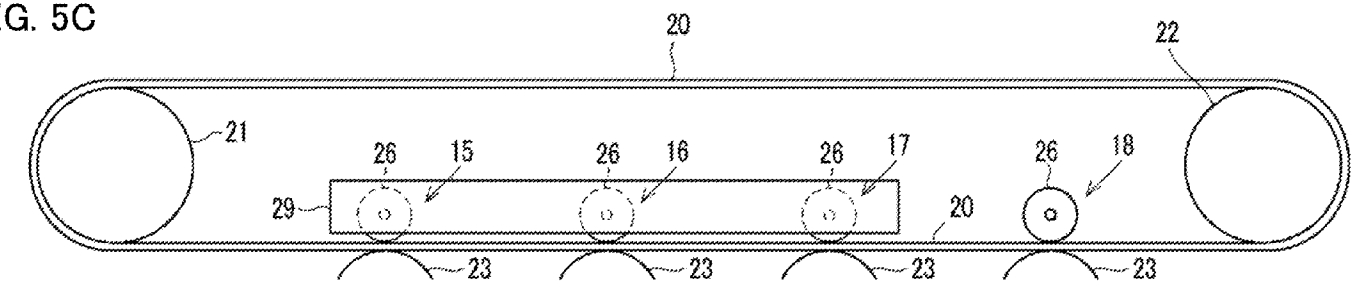
FIG. 5C is a diagram showing a positional relationship between each primary transfer roller and each photosensitive drum in a color image forming period.

Although not described in detail, the respective primary transfer rollers 26 of the single-color image forming portions 15 to 17 corresponding to Y (yellow), C (cyan), and M (magenta) other than K (black) are integrated by a housing 29 different from the unit main body 35, as shown in FIGS. 5B and 5C. The housing 29 is provided within the unit main body 35.

As shown in FIGS. 5B and 5C, in a state where the intermediate transfer unit 30 has taken the horizontal attitude, the housing 29 is changeable in attitude between a first attitude and a second attitude within the intermediate transfer unit 30 by a drive mechanism that is not shown.

As shown in FIG. 5B, when the housing 29 is in the first attitude, the primary transfer rollers 26 of the single-color image forming portions 15 to 17 are separated from the transfer belt 20. Accordingly, in each of the single-color image forming portions 15 to 17, a state is obtained in which the primary transfer roller 26 and the photosensitive drum 23 do not nip the transfer belt 20 therebetween. Therefore, a state is obtained in which only the primary transfer roller 26 and the photosensitive drum 23 in the single-color image forming portion 18 corresponding to K (black) nip the transfer belt 20 therebetween. In this state, the image forming apparatus 10 performs an image forming process of forming a monochrome image.

As shown in FIG. 5C, by the housing 29 being set in the second attitude, the primary transfer rollers 26 of the single-color image forming portions 15 to 17 are brought into contact with the transfer belt 20. Accordingly, in all the single-color image forming portions 15 to 18, a state is obtained in which the primary transfer roller 26 and the photosensitive drum 23 nip the transfer belt 20 therebetween. In this state, the image forming apparatus 10 performs an image forming process of forming a color image.

In the apparatus main body 5, a pair of rail members 38 are provided. As shown in FIG. 3B, the pair of rail members 38 are provided on an inner wall surface 36A of the front plate 36 and an inner wall surface 37A of the rear plate 37, respectively, in the apparatus main body 5 and along the right-left direction 3. That is, the pair of rail members 38 are provided so as to be spaced apart from each other, in the front-rear direction 4, across the housing space S1 for the intermediate transfer unit 30. The pair of rail members 38 support the intermediate transfer unit 30 inserted in the housing space S1, and support the rotation shaft 49 of the driving roller 22 such that the rotation shaft 49 is movable in the right-left direction 3 when the intermediate transfer unit 30 is inserted or pulled. The rail members 38 are an example of a support member of the present disclosure.

Figure 6A:
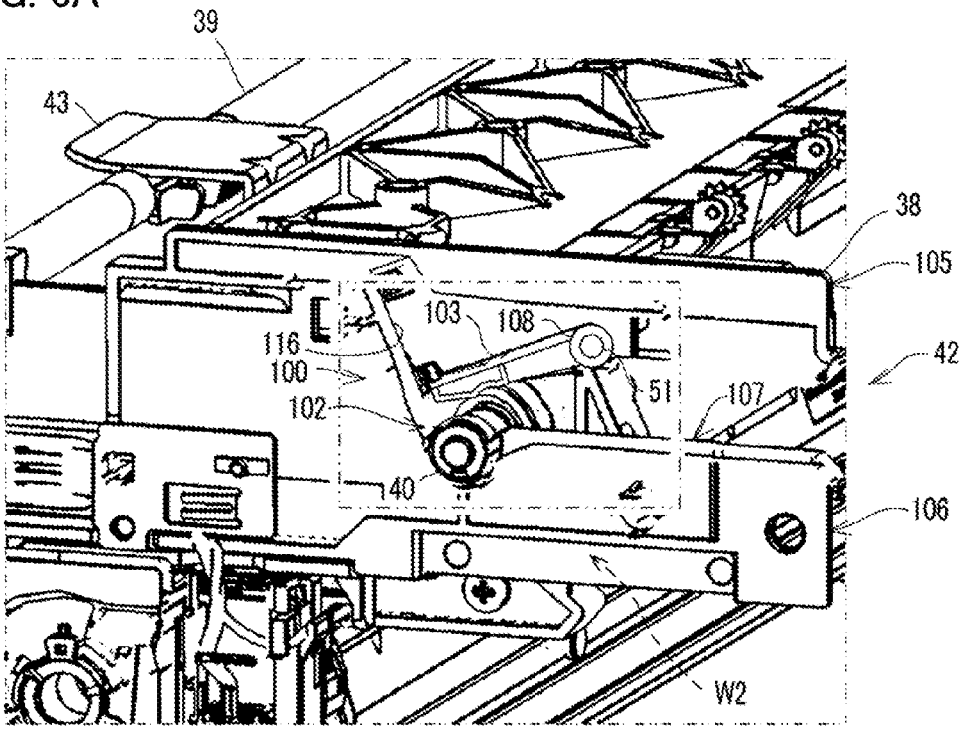
FIG. 6A is an enlarged view of a part indicated by an arrow W1 in FIG. 2 and shows a structure around a right end portion of a rail member.
Figure 6B:
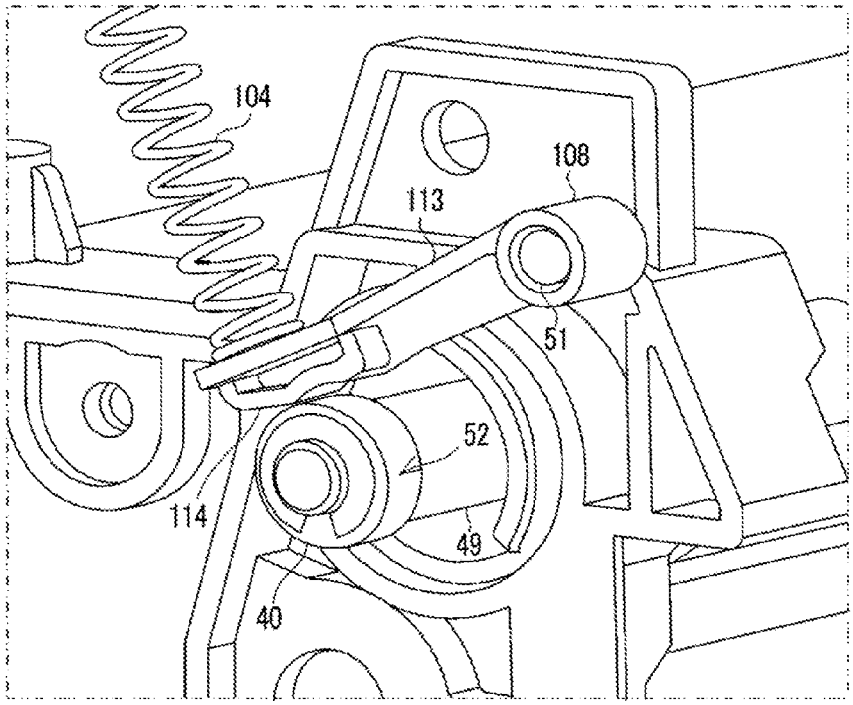
FIG. 6B is an enlarged view of a part indicated by an arrow W2 in FIG. 6A.
Figure 7:
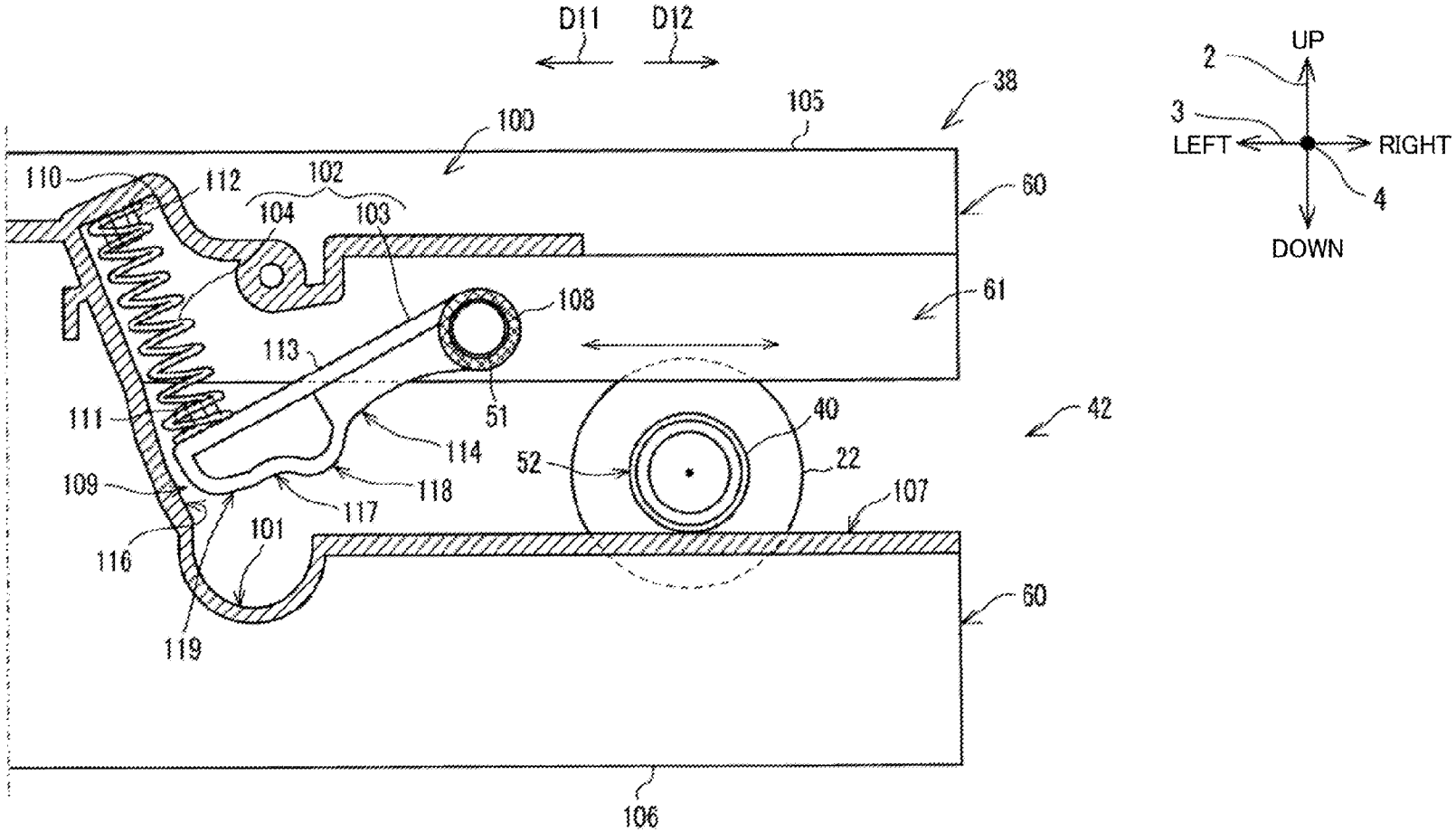
FIG. 7 is a schematic diagram showing the configuration of the rail member and a positioning mechanism.

FIG. 6A is an enlarged view of a part indicated by an arrow W1 in FIG. 2 and shows a structure around a right end portion of the rail member 38. FIG. 6B is an enlarged view of a part indicated by an arrow W2 in FIG. 6A. In FIG. 6B, the rail member 38 is not shown. FIG. 7 is a schematic diagram showing the structure around the right end portion of the rail member 38.

As shown in FIGS. 6A and 7, the rail member 38 has a guide groove 42 that slidably guides and supports an end portion of the rotation shaft 49 of the driving roller 22 in a process in which the intermediate transfer unit 30 is inserted or pulled into or from the apparatus main body 5. In the present embodiment, the rotation shaft 49 of the driving roller 22 is supported by the guide groove 42 via the bearing member 40 provided at the end portion of the rotation shaft 49.

As shown in FIG. 7, the guide groove 42 extends from an end portion, at the opening 41 side, of each rail member 38 toward the inserting direction D11 (the leftward direction) by a predetermined length. By the guide groove 42, a predetermined range of the rail member 38, including the right end portion, is formed in a shape branching into two parts. Hereinafter, of the two parts into which the rail member 38 is branched by the guide groove 42, the part located at the upper side is referred to as upper leg portion 105, and the part located at the lower side is referred to as lower leg portion 106.

The guide groove 42 includes: an upper edge portion 107 that extends on the lower leg portion 106 of the rail member 38 and in the right-left direction 3; and a lateral edge portion 116 that is located at a deep portion of the upper edge portion 107 at the downstream side in the inserting direction D11. The lateral edge portion 116 is tilted obliquely upward so as to extend from the end of the upper edge portion 107 in the inserting direction D11 toward the side opposite to the opening 41 (toward the inserting direction D11 side), and forms a wall surface at the deep side in the inserting direction D11 in the guide groove 42.

As shown in FIGS. 6B and 7, the bearing member 40 is provided at the end portion of the rotation shaft 49 of the driving roller 22. The bearing member 40 allows the driving roller 22 to rotate relative to the apparatus main body 5. The bearing member 40 is slidably guided by the upper edge portion 107 when the intermediate transfer unit 30 is inserted into the apparatus main body 5. That is, the upper edge portion 107 is a guide surface for the bearing member 40 and the rotation shaft 49.

When the intermediate transfer unit 30 is in the horizontal attitude, the bearing member 40 fits into the later-described positioning groove 101 (see FIG. 7) provided on the lower leg portion 106 of the rail member 38, to come into engagement with the positioning groove 101. In addition, when the intermediate transfer unit 30 is in the tilted attitude, the bearing member 40 escapes above from the positioning groove 101. Hereinafter, the position of the bearing member 40 that has fitted into the positioning groove 101 is referred to as fit-in position, and the position of the bearing member 40 that has escaped above from the positioning groove 101 is referred to as escape position. The drive mechanism 71 drives the intermediate transfer unit 30 such that the bearing member 40 is displaced between the fit-in position and the escape position.

Incidentally, in the conventional art, when the rotation shaft 49 escapes from the positioning groove 101, a pressing force is applied to the rotation shaft 49 in a direction opposite to the inserting direction in which the intermediate transfer unit 30 is inserted, that is, in a puffing-out direction in which the intermediate transfer unit 30 is pulled out. Thus, when the rotation shaft 49 escapes from the positioning groove 101, the intermediate transfer unit 30 is displaced in the pulling-out direction by the pressing force in some cases. In order to prevent this displacement, in the present embodiment, the image forming apparatus 10 is provided with a positioning mechanism 100.

The image forming apparatus 10 includes the positioning mechanism 100 for positioning the intermediate transfer unit 30 in the apparatus main body 5. The positioning mechanism 100 is provided in corresponding relation to each end portion of the rotation shaft 49 of the driving roller 22 and includes the positioning groove 101 and a pressing mechanism 102.

The positioning groove 101 is provided on the guide surface, for the bearing member 40, in the guide groove 42. In the present embodiment, the positioning groove 101 is provided at the deep portion, at the downstream side in the inserting direction D11, of the upper edge portion 107 on the lower leg portion 106 of the rail member 38, in other words, at a position, on the upper edge portion 107, at the side near the lateral edge portion 116. That is, the positioning groove 101 is formed at the end, at the inserting direction D11 side, of the upper edge portion 107 of the guide groove 42, and the lateral edge portion 116 extends obliquely leftward and upward from a groove wall, at the inserting direction D11 side, of the positioning groove 101. The positioning groove 101 is a recess having a circular arc shape with a diameter that is substantially equal to the diameter of the bearing member 40, and the bearing member 40 can fit into the positioning groove 101. When the bearing member 40 fits into the positioning groove 101, the intermediate transfer unit 30 is positioned at a predetermined mounting position in a fit-in state where the rotation shaft 49 has fitted in the positioning groove 101. A part of the circumferential surface of the bearing member 40 is exposed from the positioning groove 101 even in the state where the bearing member 40 has fitted in the positioning groove 101.

The rail member 38 includes a vertical wall portion (not shown) that is adjacent to the bearing member 40 that has fitted in the positioning groove 101, at the outer side in the axial direction of the rotation shaft 49, and the vertical wall portion restricts the bearing member 40 to be displaced in the axial direction of the rotation shaft 49.

As shown in FIGS. 6B and 7, the pressing mechanism 102 includes a pressing member 103 and a biasing member 104.

The pressing member 103 is rotatably mounted on the rail member 38. Specifically, the upper leg portion 105 of the rail member 38 has a mounting surface 61. The mounting surface 61 of the rail member 38 at the front side faces the front plate 36, and the mounting surface 61 of the rail member 38 at the rear side faces the rear plate 37. Each mounting surface 61 is located inward of the upper edge portion 107 of the lower leg portion 106. A rotation support shaft 51 is provided on the mounting surface 61 so as to extend outward in the axial direction of the rotation shaft 49. The rotation support shaft 51 has a circular cross-section and is provided at the opening 41 side with respect to the positioning groove 101. As described above, the pressing member 103 is provided so as to be rotatable about the rotation support shaft 51 that is provided at the opening 41 side with respect to the positioning groove 101 and extends in the axial direction.

The pressing member 103 is a member for pressing the rotation shaft 49 of the driving roller 22. In the present embodiment, the pressing member 103 is an arm-like hard member extending in one direction, and includes a proximal end portion 108, a distal end portion 109, a back surface portion 113, and a lower surface portion 114.

The proximal end portion 108 of the pressing member 103 is formed in a cylindrical shape. The pressing member 103 is fitted at the proximal end portion 108 on the rotation support shaft 51 of the rail member 38 in such an attitude that the distal end portion 109 is directed to the lateral edge portion 116 of the rail member 38. Thus, the pressing member 103 is rotatably supported on a surface orthogonal to the rotation shaft 49. The bearing member 40 can slide on this surface to come into contact with the pressing member 103.

In the present embodiment, an object to be pressed directly by the pressing member 103 is the bearing member 40, and the rotation shaft 49 is pressed indirectly by the pressing member 103 via the bearing member 40. However, the present disclosure is not limited to the configuration in which the rotation shaft 49 is pressed indirectly by the pressing member 103 via the bearing member 40, and the rotation shaft 49 may be pressed directly by the pressing member 103. In addition, in the present embodiment, the object to fit into or escape from the positioning groove 101 is the bearing member 40, not the rotation shaft 49. However, the present disclosure is not limited to the configuration in which the bearing member 40 for the rotation shaft 49 fits into or escapes from the positioning groove 101, and the rotation shaft 49 itself may fit into or escape from the positioning groove 101.

The lower surface portion 114 of the distal end portion 109 of the pressing member 103 is a contact portion that comes into contact with the circumferential surface of the bearing member 40. The pressing member 103 receives a biasing force from the later-described biasing member 104 and applies a pressing force to the rotation shaft 49 from above the rotation shaft 49. Specifically, when the rotation shaft 49 is present in the range from the fit-in position at which the rotation shaft 49 has fitted in the positioning groove 101 to the escape position at which the rotation shaft 49 has escaped from the positioning groove 101, the pressing member 103 comes into contact with the rotation shaft 49 to press the rotation shaft 49 in the groove depth direction of the positioning groove 101. The lower surface portion 114 applies a pressing force F1 (see FIG. 8) in the groove depth direction to the rotation shaft 49 in the fit-in state where the rotation shaft 49 has fitted in the positioning groove 101. In addition, the lower surface portion 114 applies a pressing force F2 (see FIG. 10), including a component force in the inserting direction D11 (the leftward direction), to the rotation shaft 49 against the above pressing force in an escape state where the rotation shaft 49 is located at the escape position. In the fit-in state where the bearing member 40 has fitted in the positioning groove 101, the lower surface portion 114 is in contact with a portion of the circumferential surface of the bearing member 40 which portion is exposed from the positioning groove 101. The lower surface portion 114 is an example of a pressing force application portion of the present disclosure. The pressing force F1 is an example of a first pressing force of the present disclosure, and the pressing force F2 is an example of a second pressing force of the present disclosure.

The biasing member 104 applies, to the pressing member 103, a biasing force that biases the pressing member 103 toward the contact portion side. In other words, the biasing member 104 applies, to the pressing member 103, a biasing force in a direction in which the lower surface portion 114 comes into contact with the rotation shaft 49. The biasing member 104 is, for example, a coil spring. The biasing member 104 is interposed between the rail member 38 and the pressing member 103. Specifically, the upper leg portion 105 of the rail member 38 is provided with a mounting surface 110 that faces the back surface portion 113 of the pressing member 103. The mounting surface 110 and the back surface portion 113 of the pressing member 103 are provided with a pair of boss portions 111 and 112. The biasing member 104 is mounted between the boss portions 111 and 112 in a compressed state. When the intermediate transfer unit 30 is not mounted, the biasing member 104 is biased toward the positioning groove 101 side to bring the distal end portion 109 into contact with the upper edge portion 107. At this time, a slide movement path for the rotation shaft 49 to the positioning groove 101 in the guide groove 42 is blocked by the pressing member 103.

The lower surface portion 114 is provided with a recess portion 117 and two projection portions 118 and 119, and the recess portion 117 is formed by the two projection portions 118 and 119. The projection portions 118 and 119 are spaced apart from each other in the direction in which the pressing member 103 extends, and the recess portion 117 is formed therebetween. Thus, as described later, the projection portion 119, at the inserting direction D11 (the leftward direction) side, of the lower surface portion 114 is in contact at one contact point P1 (see FIG. 8) with the bearing member 40 in a state where the bearing member 40 is located at the fit-in position, and the projection portion 118 and the projection portion 119 of the lower surface portion 114 are in contact at respective one points (contact points P2 and P3 (see FIG. 10)) with the bearing member 40 in a state where the bearing member 40 is located at the escape position. The contact point P1 is an example of a first contact point of the present disclosure. The contact point P2 is an example of a second contact point of the present disclosure, and the contact point P3 is an example of a third contact point of the present disclosure. The contact point P3 is located at the inserting direction D11 side with respect to the contact point P2.

When the rotation shaft 49 is in the fit-in state, the pressing member 103 applies the pressing force F1 to the circumferential surface of the rotation shaft 49 at the contact point P1. In addition, when the rotation shaft 49 is in the escape state, the pressing member 103 applies a pressing force F3, including a first component force F3*x* (see FIG. 10B) in a direction opposite to the inserting direction D11 (in the direction toward the opening 41 side, in the rightward direction), to the circumferential surface of the rotation shaft 49 at the contact point P3. Hereinafter, the direction opposite to the inserting direction D11 is referred to as pulling-out direction D12. The pulling-out direction D12 is a direction in which the intermediate transfer unit 30 is pulled out, and coincides with the rightward direction. The puffing-out direction D12 is an example of a second direction of the present disclosure. In addition, when the rotation shaft 49 is in the escape state, the pressing member 103 applies the pressing force F2, including a second component force F2*x* (see FIG. 10) in the inserting direction D11 greater than the first component force F3*x*, to the circumferential surface of the rotation shaft 49 at the contact point P2. The pressing forces F1, F2, and F3 are forces obtained from the biasing force of the biasing member 104, and are forces acting at the respective contact points when the pressing member 103 receives the biasing force. The pressing force F3 is an example of a third pressing force of the present disclosure.

Next, operation of the positioning mechanism 100 will be described.

When insertion of the intermediate transfer unit 30 is started and the intermediate transfer unit 30 is inserted by a certain amount, the bearing members 40 provided at both end portions of the driving roller 22 come into contact with the upper edge portions 107 on the lower leg portions 106 of the rail members 38. Then, when the intermediate transfer unit 30 is further inserted, each bearing member 40 slides in the inserting direction D11 (the leftward direction) toward the positioning groove 101 while being guided by the guide groove 42 in slide contact with the upper edge portion 107. At this time, the intermediate transfer unit 30 is in the tilted attitude.

Thereafter, when each bearing member 40 reaches a predetermined position at the upstream side in the inserting direction D11 with respect to the positioning groove 101, the lower surface portion 114 of the distal end portion 109 of the pressing member 103 and a circumferential surface 52 of each bearing member 40 come into contact with each other. As each bearing member 40 comes close to the positioning groove 101, the distal end portion 109 of the pressing member 103 is pressed upward by the bearing member 40, so that the amount of contraction of the biasing member 104, that is, the magnitude of a pressing force with which the pressing member 103 presses the bearing member 40, increases.

Figure 8:
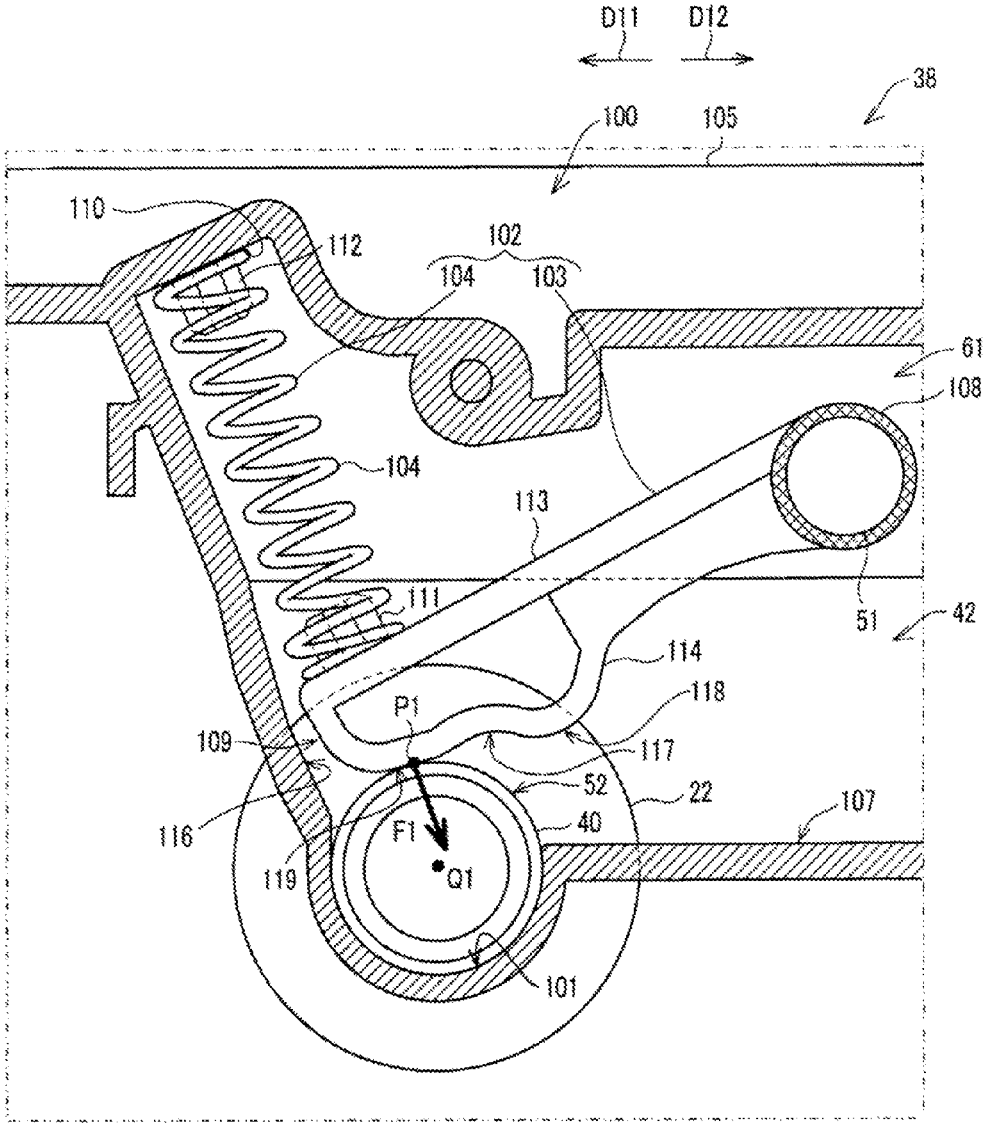
FIG. 8 is a diagram showing a state where a bearing member fits into a positioning groove.

Then, as shown in FIG. 8, the bearing member 40 fits into the positioning groove 101. Thus, movement of the bearing member 40 in the right-left direction 3 is restricted, resulting in movement of the intermediate transfer unit 30 in the inserting/pulling direction 3 being restricted. At this time, the intermediate transfer unit 30 is in the horizontal attitude. The position of the intermediate transfer unit 30 at this time is referred to as mounting position. In addition, at this time, the pressing member 103 rotates such that the distal end portion 109 of the pressing member 103 is displaced downward by a predetermined amount while pressing the bearing member 40.

At this time, as shown in FIG. 8, the pressing member 103 comes into contact with the bearing member 40 at the contact point P1 on the lower surface portion 114, and applies, at the contact point P1, the pressing force F1 in the direction in which the bearing member 40 is pressed against the inner circumferential surface of the positioning groove 101.

Thus, even when the driving roller 22 vibrates or some kind of shock is applied to the driving roller 22, the bearing member 40 can be prevented from moving upward from the positioning groove 101 and further the intermediate transfer unit 30 can be prevented from moving upward.

Figure 9:
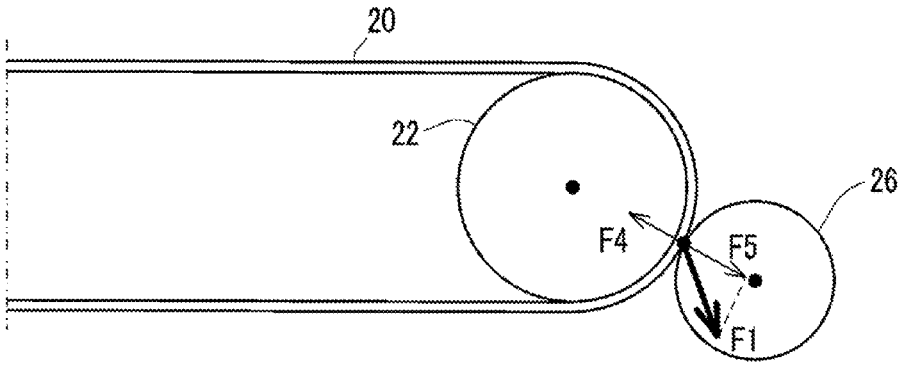
FIG. 9 is a diagram illustrating forces that interact with each other between a driving roller and a secondary transfer roller.

Here, the pressing force F1 includes a component of force in a direction opposite to the direction of the pressure contact force F4 applied by the circumferential surface of the secondary transfer roller 19 to the circumferential surface of the driving roller 22. As described above, the secondary transfer roller 19 is disposed obliquely rightward and downward of the driving roller 22, and the secondary transfer roller 19 and the driving roller 22 nip the transfer belt 20 therebetween. At this time, as shown in FIG. 9, the secondary transfer roller 19 applies, to the driving roller 22, the pressure contact force F4 in an obliquely leftward and upward direction. The pressing force F1 includes a component of force in an obliquely rightward and downward direction that is the direction opposite to the direction of the pressure contact force F4. That is, the pressing member 103 applies, to the rotation shaft 49, a pressing force F5 including a component force in a direction in which the driving roller 22 and the secondary transfer roller 19 come into pressure contact with each other, this component force being equal to or greater than the pressure contact force F4.

Thus, even when the secondary transfer roller 19 vibrates or some kind of shock is applied to the driving roller 22, the bearing member 40 can be prevented from moving upward from the positioning groove 101 and further the intermediate transfer unit 30 can be prevented from moving upward. In the image forming period, the above state is maintained.

Meanwhile, in the image non-forming period, in accordance with the intermediate transfer unit 30 being displaced from the horizontal attitude to the tilted attitude, the driving roller 22 is displaced upward by the predetermined amount, so that each bearing member 40 is displaced to the escape position against the pressing force received from the pressing member 103 (see FIG. 10).

Figure 10A:
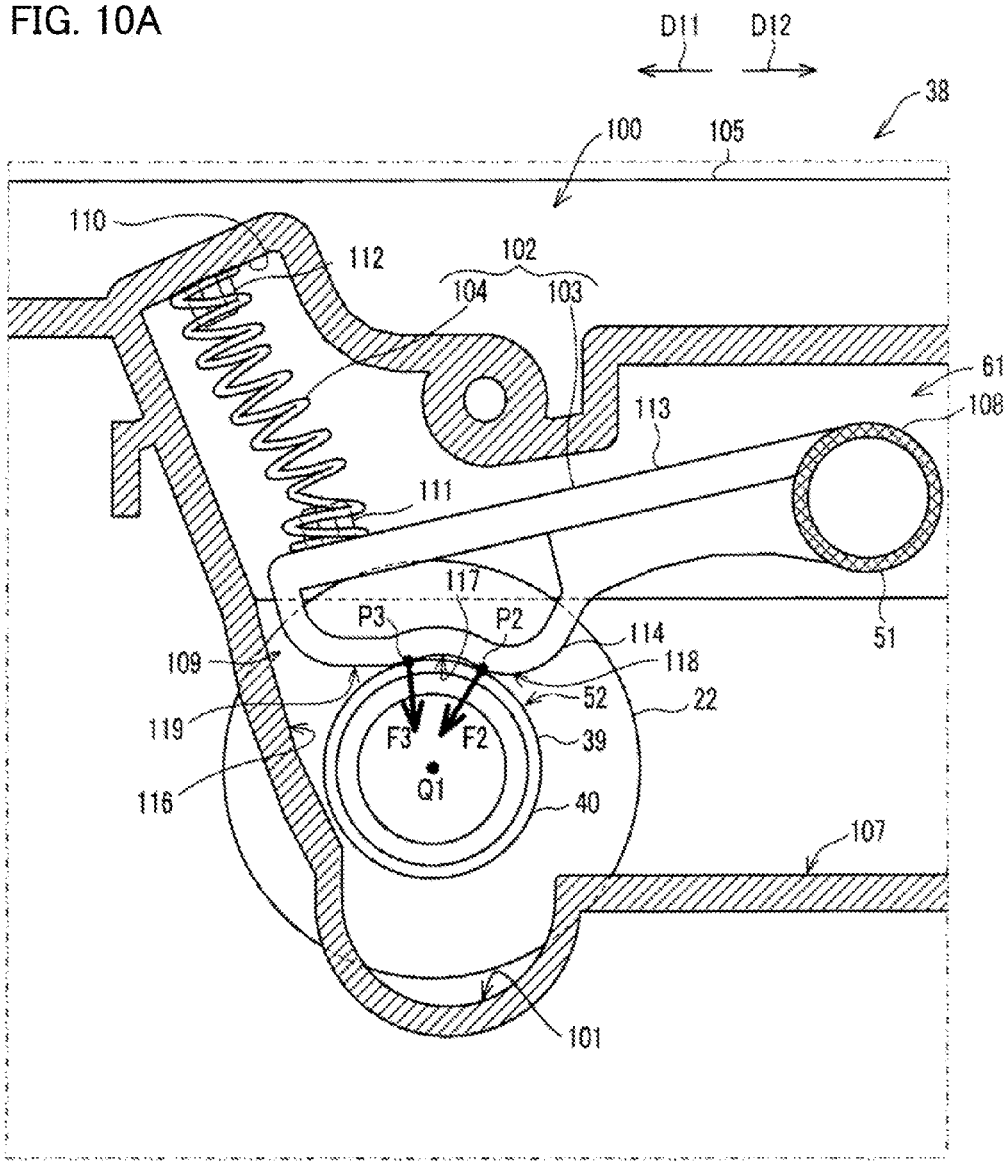
FIG. 10A is a diagram showing a state where the bearing member has escaped above from the positioning groove.
Figure 10B:
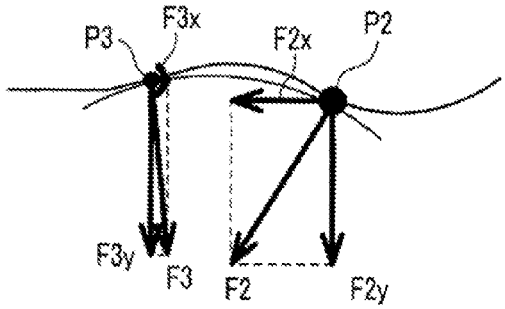
FIG. 10B is a diagram illustrating pressing forces applied by a pressing member to the bearing member that has escaped above from the positioning groove.

At this time, as shown in FIG. 10A, the pressing member 103 is in contact with the circumferential surface 52 of the bearing member 40 at a plurality of points (the contact point P2 and the contact point P3) on the lower surface portion 114. Then, the pressing member 103 applies the pressing force F2 in the direction from the bearing member 40 toward the positioning groove 101, to the bearing member 40 at the contact point P2 (second contact point), and applies the pressing force F3 in the direction from the bearing member 40 toward the positioning groove 101, to the bearing member 40 at the contact point P3 (third contact point).

These pressing forces F2 and F3 include component forces F2*y* and F3*y* that are components in a vertically downward direction. Thus, even when the driving roller 22 vibrates or some kind of shock is applied to the driving roller 22, the bearing member 40 can be prevented from moving upward from the positioning groove 101 and further the intermediate transfer unit 30 can be prevented from moving upward. The pressing force F3 may be composed of only a component of force in the vertically downward direction.

Furthermore, the pressing force F2 includes the second component force F2*x* that is a component in a direction toward the downstream side in the inserting direction D11. Here, if the pressing force F3 includes the first component force F3*x* that is a component in a direction toward the upstream side in the inserting direction D11, the second component force F2*x* is greater than the first component force F3*x*. The second component force F2*x* restricts displacement of the bearing member 40 toward the upstream side in the inserting direction D11, so that the bearing member 40 is held at the escape position. As a result, when the intermediate transfer unit 30 is made into the tilted attitude so that the bearing member 40 is displaced to the escape position, the bearing member 40 can be prevented from being displaced toward the upstream side in the inserting direction D11. Accordingly, the intermediate transfer unit 30 can be prevented from being displaced toward the upstream side in the inserting direction D11.

Second Embodiment

Next, a second embodiment of the present disclosure will be described. In the present embodiment, the following configuration is added to the configuration in the first embodiment.

Figure 11:
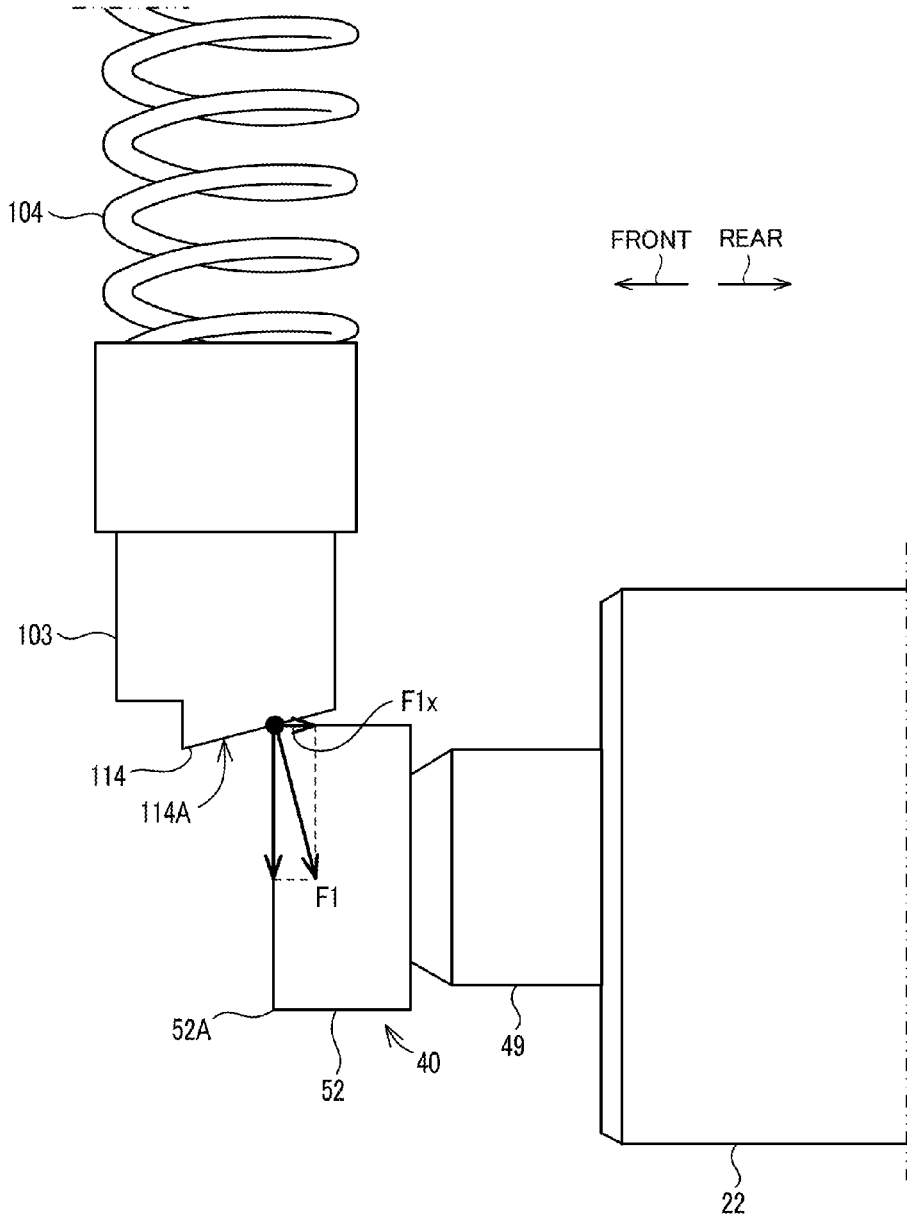
FIG. 11 is a diagram showing the configuration of a pressing member according to a second embodiment of the present disclosure.

As shown in FIG. 11, in the present embodiment, the lower surface portion 114 of the pressing member 103 corresponding to one end portion of the rotation shaft 49 has an inclined surface 114A. In a state where the bearing member 40 has fitted in the positioning groove 101, the inclined surface 114A is in contact with an end portion of the bearing member 40 at the outer side in the axial direction of the rotation shaft 49. In other words, the inclined surface 114A is in contact with an edge portion 52A, at the outer side in the axial direction, of the circumferential surface 52 of the bearing member 40. Thus, the pressing force F1 applied by the pressing member 103 to the bearing member 40 includes a component force F1*x* that is a component pressing the rotation shaft 49 of the driving roller 22 toward the other side along the axial direction.

By the component force F1*x*, the other bearing member 40 is pressed against the vertical wall portion. Accordingly, the rotation shaft 49 of the driving roller 22 and further the driving roller 22 are fixed in the axial direction, and displacement of the intermediate transfer unit 30 can be prevented.

The entirety of the lower surface portion 114 of the pressing member 103 does not need to be the inclined surface 114A, and the inclined surface 114A may be formed in at least a region including the contact point P1. In addition, the pressing member 103 having the inclined surface 114A provided in the lower surface portion 114 may be either the pressing member 103 located at the front side or the pressing member 103 located at the rear side. The inclined surface 114A is an example of an inclined portion of the present disclosure.

Third Embodiment

Next, a third embodiment of the present disclosure will be described. In the present embodiment, the following configuration is added to the configuration in the first embodiment or the second embodiment.

In the present embodiment, of the pressing member 103, a part including the contact points P1 to P3, that is, the lower surface portion 114, is composed of a damping material such as rubber or sponge. The damping material may be any material as long as the material is able to damp vibration received from the rotating rotation shaft 49 at the fit-in position via the bearing member 40. Thus, vibration or the like occurring in the intermediate transfer unit 30 is reduced by the damping material of the lower surface portion 114. As a result, the pressing member 103 does not vibrate, and abnormal sound occurring due to vibration of the pressing member 103 can be prevented. In addition, vibration or the like occurring in the secondary transfer roller 19 is reduced by the damping material, and thus is less likely to be transmitted to the intermediate transfer unit 30. Moreover, resonance can be also prevented from being caused due to vibration of the pressing member 103 being transmitted to the rotation shaft 49 via the bearing member 40. If required rigidity of the pressing member 103 can be ensured, the entirety of the pressing member 103 may be composed of a damping material such as rubber in another embodiment.

The pressing member 103 does not need to be a hard member, and may be composed of an elastically deformable member such as rubber. In this case, the pressing member 103 is able to press the bearing member 40 with a pressing force generated due to elastic deformation of the pressing member 103, and thus the biasing member 104 may be omitted.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body having a housing space formed therein and an opening communicating with the housing space;

a transfer unit including an extending roller including a rotation shaft and a transfer belt supported on the extending roller, the transfer unit being able to be inserted into the housing space through the opening along a first direction that crosses an axial direction of the rotation shaft and is a direction from the opening toward the housing space;

a pair of support members provided in the apparatus main body, spaced apart from each other in the axial direction across the housing space, and configured to support the transfer unit inserted in the housing space and support the rotation shaft such that the rotation shaft is movable in the first direction;

a guide groove extending from an end portion, at an opening side, of each of the pair of support members toward the first direction so as to branch each of the pair of support members into two parts and configured to guide the rotation shaft in the first direction while supporting the rotation shaft in a process of inserting the transfer unit;

a positioning groove provided at a deep portion of a guide surface in the first direction, for the rotation shaft, in the guide groove and configured to position the transfer unit at a predetermined mounting position in a state where the rotation shaft has fitted in the positioning groove;

a pressing member provided so as to be rotatable about a support shaft provided at the opening side with respect to the positioning groove, formed in a shape of an arm extending from the support shaft in the first direction, and extending in the axial direction, the pressing member being configured to come into contact with the rotation shaft and press the rotation shaft in a groove depth direction of the positioning groove when the rotation shaft is present in a range from a fit-in position at which the rotation shaft has fitted in the positioning groove to an escape position at which the rotation shaft has escaped from the positioning groove;

a pressing force application portion including a contact portion of the pressing member, the contact portion being configured to come into contact with the rotation shaft, the pressing force application portion being configured to apply a first pressing force in the groove depth direction to the rotation shaft in a fit-in state where the rotation shaft is located at the fit-in position, and apply a second pressing force in the first direction to the rotation shaft against the first pressing force in an escape state where the rotation shaft is located at the escape position; and a biasing member located between the support members and the pressing member and configured to apply, to the pressing member, a biasing force in a direction in which the contact portion comes into contact with the rotation shaft, wherein the pressing force application portion includes a first projection portion and a second projection portion that are spaced apart from each other in an extension direction of the pressing member and project downward, wherein the first projection portion has a first contact point and a third contact point, the first contact point coming into contact with a circumferential surface of the rotation shaft in the fit-in state, the third contact point coming into contact with the circumferential surface of the rotation shaft in the escape state, the second projection portion has a second contact point that comes into contact with the circumferential surface of the rotation shaft in the escape state, and the pressing force application portion applies the first pressing force at the first contact point, applies a third pressing force, including a first component force in a second direction opposite to the first direction, to the rotation shaft at the third contact point, and applies the second pressing force, including a second component force in the first direction, to the rotation shaft at the second contact point, the second component force being greater than the first component force.

2. The image forming apparatus according to claim 1, wherein the pressing member is provided in corresponding relation to each of both end portions of the rotation shaft, and the pressing member corresponding to one end portion of the rotation shaft includes an inclined portion that is in contact with an end portion, at an outer side in the axial direction, of the rotation shaft in the fit-in state.

3. The image forming apparatus according to claim 1, further comprising a drive mechanism configured to drive the transfer unit such that the rotation shaft is displaced between the fit-in position and the escape position.

4. The image forming apparatus according to claim 1, further comprising a secondary transfer roller, disposed so as to be opposed to the extending roller in the state where the rotation shaft is located at the fit-in position, for transferring a toner image transferred onto the transfer belt, onto a sheet member, the secondary transfer roller being disposed so as to be able to come into pressure contact with a surface of the extending roller with a predetermined pressure contact force, wherein the pressing member applies, to the rotation shaft in the fit-in state, the first pressing force including a component force in a direction in which the extending roller and the secondary transfer roller come into pressure contact with each other, the component force being equal to or greater than the pressure contact force.

5. The image forming apparatus according to claim 1, wherein the contact portion is composed of a damping material that damps vibration received from the rotating rotation shaft at the fit-in position.

6. The image forming apparatus according to claim 1, wherein the transfer unit is able to be inserted into the housing space laterally through the opening formed in a side surface of the apparatus main body, the positioning groove is provided on the guide surface at a lower side in the deep portion of the guide groove, and the pressing member presses the rotation shaft from an upper side of the rotation shaft toward a lower side of the rotation shaft.

* * * * *